US011946207B2

(12) United States Patent
Watson

(10) Patent No.: US 11,946,207 B2
(45) Date of Patent: Apr. 2, 2024

(54) PORTABLE WATER SPREADER

(71) Applicant: Steve Watson, Orem, UT (US)

(72) Inventor: Steve Watson, Orem, UT (US)

( * ) Notice: Subject to any disclaimer, the term of this patent is extended or adjusted under 35 U.S.C. 154(b) by 794 days.

(21) Appl. No.: 17/107,155

(22) Filed: Nov. 30, 2020

(65) Prior Publication Data

US 2022/0170216 A1 Jun. 2, 2022

(51) Int. Cl.
*E01C 19/17* (2006.01)

(52) U.S. Cl.
CPC ..... *E01C 19/174* (2013.01); *E01C 19/176* (2013.01)

(58) Field of Classification Search
CPC ..... E01C 19/17; E01C 19/174; B65D 7/40; B65D 88/06; B65D 88/08; B65D 88/12; B65D 88/128; B65D 25/38; B65D 25/40; B65D 25/42; B65D 25/46; B65D 25/465
USPC ..... 220/562, 647; 239/146
See application file for complete search history.

(56) References Cited

U.S. PATENT DOCUMENTS

2016/0312423 A1* 10/2016 Kohn ..... E01H 10/007
2018/0106005 A1* 4/2018 Strelcheck ..... A01C 15/003

* cited by examiner

*Primary Examiner* — Qingzhang Zhou
*Assistant Examiner* — Juan C Barrera
(74) *Attorney, Agent, or Firm* — Thorpe North & Western, LLP

(57) ABSTRACT

A portable water spreader has a water tank with a coupler to couple to and be elevated and tilted by a front-end loader. Discharge pipes are coupled to the tank with spray heads. Vent pipes are coupled to the tank.

17 Claims, 9 Drawing Sheets

PORTABLE WATER SPREADER

BACKGROUND

For proper road base construction water must be applied precisely and consistently. Water is typically applied by large water trucks. Proper road base is required even for smaller curb and gutter projects. The use of water trucks on smaller jobs can result in water being applied beyond the job site and creation of a muddy work site. Smaller water trailers have been developed but can be difficult to maneuver for proper water placement. Some job sites can also be remote and/or difficult to access with a large water truck. The development of solutions is an ongoing endeavor.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1:
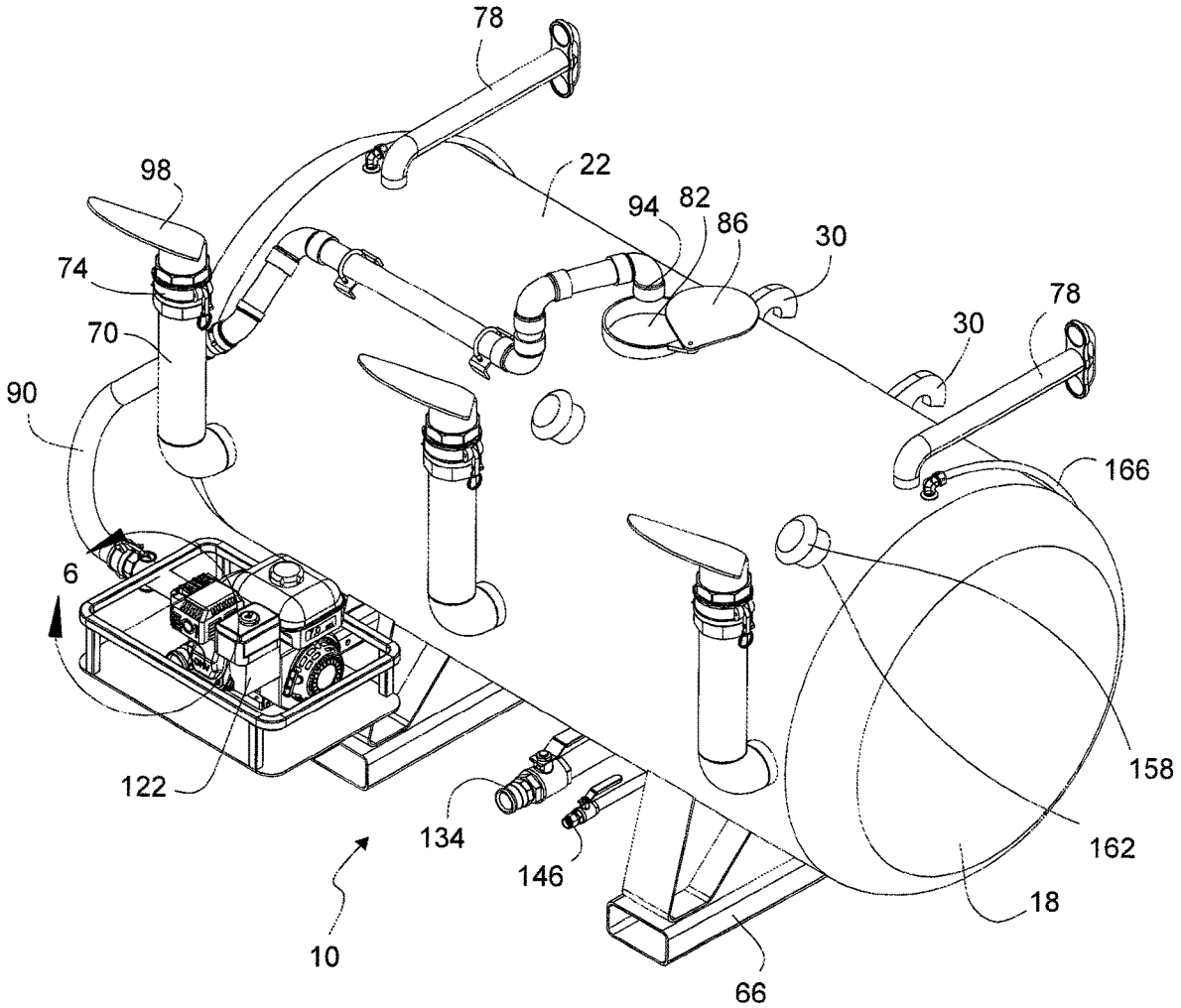
FIG. 1 is a perspective view of a portable water spreader in accordance with an embodiment of the invention, shown in an upright orientation.

Reference will now be made to the exemplary embodiments illustrated, and specific language will be used herein to describe the same. It will nevertheless be understood that no limitation of the scope of the invention is thereby intended.

DETAILED DESCRIPTION

Before invention embodiments are disclosed and described, it is to be understood that no limitation to the particular structures, process steps, or materials disclosed herein is intended, but also includes equivalents thereof as would be recognized by those ordinarily skilled in the relevant arts. It should also be understood that terminology employed herein is used for the purpose of describing particular examples only and is not intended to be limiting. The same reference numerals in different drawings represent the same element. Numbers provided in flow charts and processes are provided for clarity in illustrating steps and operations and do not necessarily indicate a particular order or sequence. Unless defined otherwise, all technical and scientific terms used herein have the same meaning as commonly understood by one of ordinary skill in the art to which this disclosure belongs.

As used in this specification and the appended claims, the singular forms "a," "an" and "the" include plural referents unless the context clearly dictates otherwise. Thus, for example, reference to "a layer" includes a plurality of such layers.

In this disclosure, "comprises," "comprising," "containing" and "having" and the like can have the meaning ascribed to them in U.S. Patent law and can mean "includes," "including," and the like, and are generally interpreted to be open ended terms. The terms "consisting of" or "consists of" are closed terms, and include only the components, structures, steps, or the like specifically listed in conjunction with such terms, as well as that which is in accordance with U.S. Patent law. "Consisting essentially of" or "consists essentially of" have the meaning generally ascribed to them by U.S. Patent law. In particular, such terms are generally closed terms, with the exception of allowing inclusion of additional items, materials, components, steps, or elements, that do not materially affect the basic and novel characteristics or function of the item(s) used in connection therewith. For example, trace elements present in a composition, but not affecting the composition's nature or characteristics would be permissible if present under the "consisting essentially of" language, even though not expressly recited in a list of items following such terminology. When using an open ended term in the specification, like "comprising" or "including," it is understood that direct support should be afforded also to "consisting essentially of" language as well as "consisting of" language as if stated explicitly and vice versa.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments described herein are, for example, capable of operation in other orientations than those illustrated or otherwise described herein.

The term "coupled," as used herein, is defined as directly or indirectly connected in an electrical or nonelectrical manner. Objects described herein as being "adjacent to" each other may be in physical contact with each other, in close proximity to each other, or in the same general region or area as each other, as appropriate for the context in which the phrase is used. Occurrences of the phrase "in one embodiment," or "in one aspect," herein do not necessarily all refer to the same embodiment or aspect.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

As used herein, the term "about" is used to provide flexibility to a numerical range endpoint by providing that a given value may be "a little above" or "a little below" the endpoint. It is understood that express support is intended for exact numerical values in this specification, even when the term "about" is used in connection therewith.

The term "front-end loader" is used broadly herein to refer to a heavy equipment machine and vehicle used in construction to move or load materials, and that has wheels or tracks, a motor, and a cab. Such a loader may also have a boom and hydraulic system. Thus, the term "front-end loader" is intended to include, unless otherwise specified, a skid loader a skid-steer loader, and a backhoe.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

A portable water spreader is presented that allows a smaller amount of water to be more precisely and consistently applied or spread in construction and industrial sites, such as when constructing a road base with specific moisture requirements. The smaller volume of the spreader can be between 150 to 1500 gallons, and is small relative to water trucks. The spreader can also be easier to handle and direct with respect to water trucks and/or water trailers. The spreader is also capable of a finer and smaller application relative to water trucks and/or water trailers to avoid over spray and muddy work sites. The spreader provides for a connection to a front-end loader or the like for ease of use and finer application, and allowing the spreader to be lifted and tilted. For example, gutter and sidewalk projects have the same road base moisture requirement as larger roads but applying water with a water truck or trailer can be difficult with the larger truck and unwieldy trailer. Meanwhile, both the truck and the trailer can create muddy sites with the over application of the truck and the misdirection of the trailer. In addition, the spreader allows access to remote areas and over rough terrain.

Referring to FIGS. 1-15, a portable water spreader 10 is shown by way of example for spreading water is smaller amounts, relative to water trucks and trailers, and in a precise manner. The spreader 10 can provide precise water delivery and consistent application for construction and industrial application, such as road base construction with moisture requirements for the road base. In one aspect, the spreader 10 can have a volume of between 150 to 1500 gallons, which can be small relative to water trucks. In addition, the spreader 10 can be manipulated by a front end loader 14, and thus can apply water more precisely and consistently relative to a water trailer.

Figure 9:
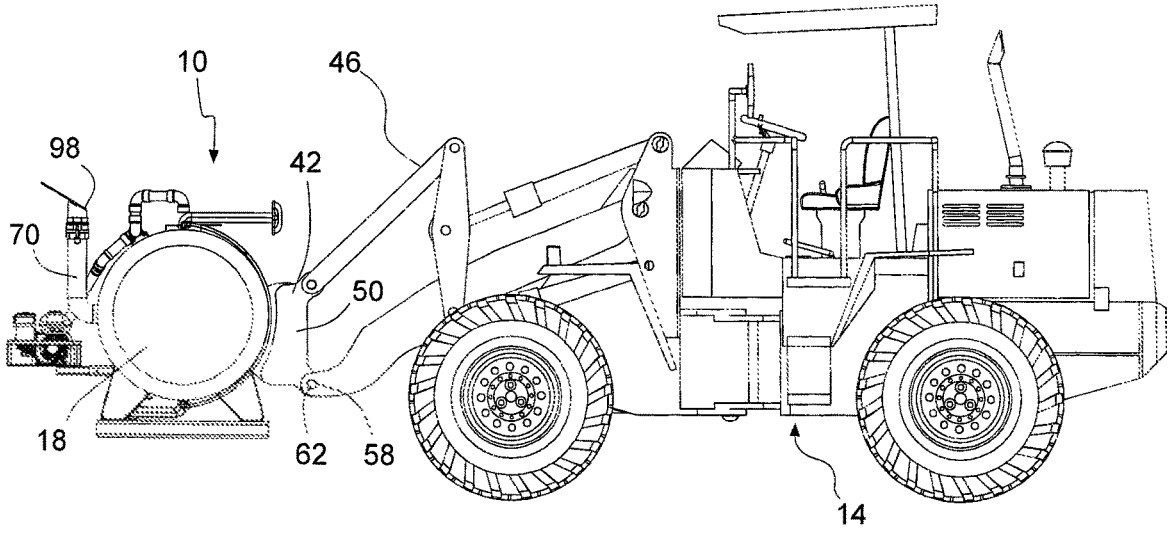
FIG. 9 is a side view of the portable water spreader of FIG. 1, shown connected to the front-end loader, and shown in the upright orientation.
Figure 10:
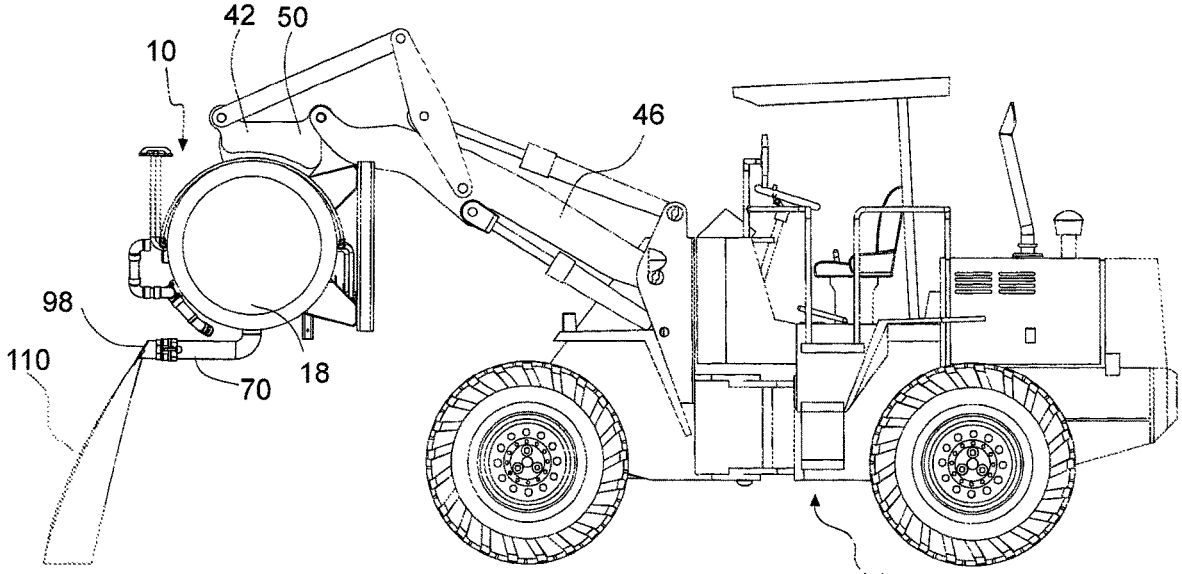
FIG. 10 is a side view of the portable water spreader of FIG. 1, shown connected to the front-end loader, and shown in the raised position and the tilted orientation.
Figure 11:
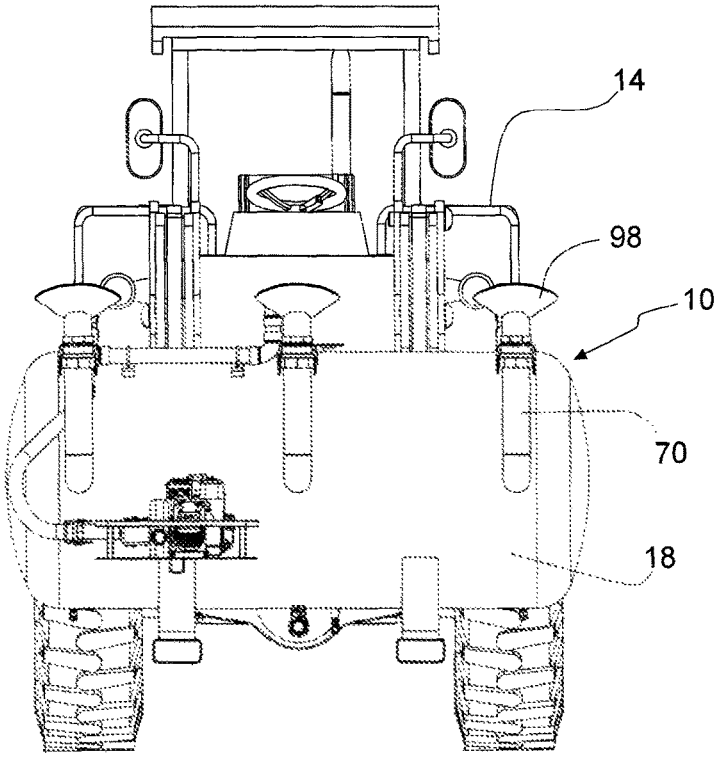
FIG. 11 is a front view of the portable water spreader of FIG. 1, shown connected to the front-end loader, and shown in the upright orientation.
Figure 12:
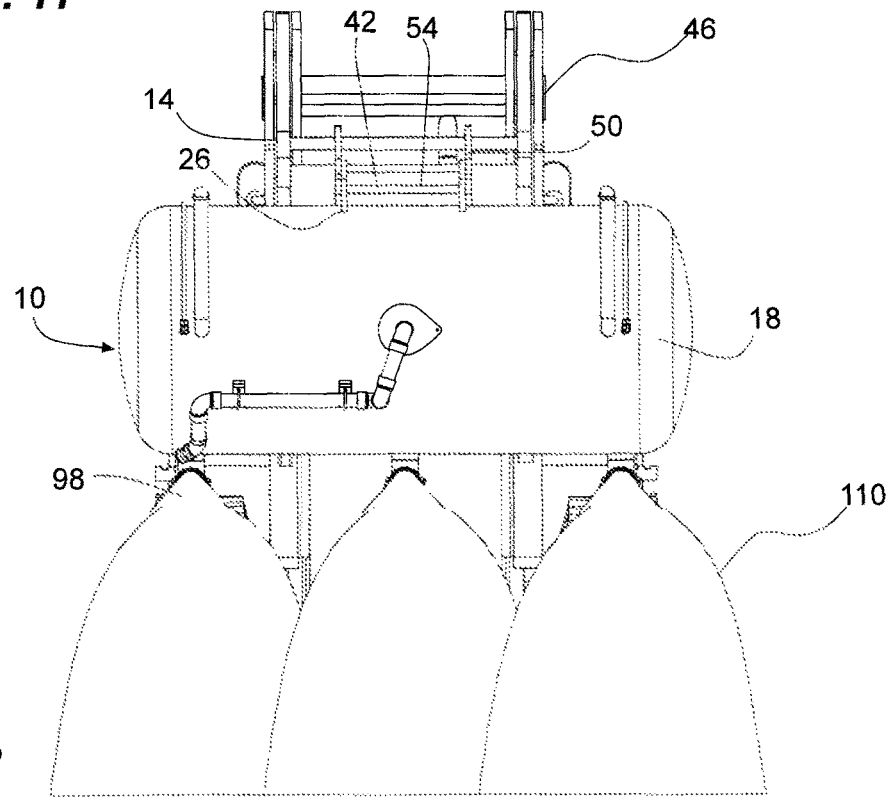
FIG. 12 is a front view of the portable water spreader of FIG. 1, shown connected to the front-end loader, and shown in the raised position and the tilted orientation.

The spreader 10 has a water tank 18 with a tank wall 22. As described above, the tank 18 can have a volume between 150 and 1500 gallons in one aspect. In one aspect, the water tank can be cylindrical with convex ends. The water tank 10 and the tank wall 22 can be formed of metal. Thus, the water tank 10 can be a structural water tank and the tank walls 22 can be structural and capable of both containing water and being handled, transported and oriented. The spreader 10 and the water tank 18 are capable of being vertically displaceable between: 1) a lowered position, and shown in FIGS. 1-3 and 7; and 2) a raised position elevated above the ground, as shown in FIGS. 8, 10 and 12-15. In addition, the spreader 10 and the water tank 18 are also capable of being tiltable between: 1) an upright orientation, as shown in FIGS. 1-3, 7, 9 and 11; and 2) a tilted orientation substantially 90 degrees from the upright orientation, as shown in FIGS. 8, 10 and 12-15. In the lowered position and upright orientation, the spreader 10 can be disposed on a support surface, such as the ground. The spreader 10 and the tank 18 can also be raise or elevated to an intermediate elevation for transport or displacement thereof, as shown in FIGS. 9 and 11.

The spreader 10 can be removably coupled to the front-end loader 14 with a quick coupler. One portion of the quick-coupler 26 can be part of the spreader 10 and the water tank 18, while another portion of the quick-coupler 42 can be part of the front-end loader 14. The spreader 10, the water tank 18 and the tank wall 22 can have one portion of a quick-coupler 26 of a front-end loader 14. The quick-coupler 26 can be carried by and mounted to the tank wall 22, and positioned on a back side of the water tank 18 with the back side referenced in the upright orientation. In one aspect, the one portion of the quick-coupler 26 can have a pair of flanges 30 laterally spaced-apart on the back side of the water tank 18. The flanges 30 can be mounted to the tank wall 22. The flanges 30 can have an arcuate edge to match a curvature of the tank wall 22. The flanges 30 can be formed of metal and can be welded to the tank wall 22. Each flange 30 can have a hook 34 at a top thereof and a bore 38 at a bottom thereof.

Another portion of the quick-coupler 42 can be carried by a boom 46 the front-end loader 14. The another portion of the quick-coupler 42 can have a bracket 50 (FIG. 8), which can have another pair of spaced-apart flanges. The quick-coupler 42 can have at least one bar 54 (FIG. 8) at a top of the bracket 50 and corresponding to the hooks 34 of the pair of flanges 30 of the one portion of the quick-coupler 26. In addition, the quick-coupler 42 can have at least one bore 58 (FIG. 9) at a bottom of the bracket 50 and corresponding to and aligning with the bores 38 in the pair of flanges 30. At least one pin 62 (FIG. 9) can be removably received in the at least one bore 58 of the bracket 50 and the bore 38 in each of the pair of flanges 30. Thus, the boom 46 of the front-end loader 14 can hook the bar 54 of the another quick-coupler 42 to the hook 34 of the one quick-coupler 26, and pivot to align the bores 38 and 58 to receive the pin 62, thus coupling the spreader 10 to the front-end loader 14.

Figure 2:
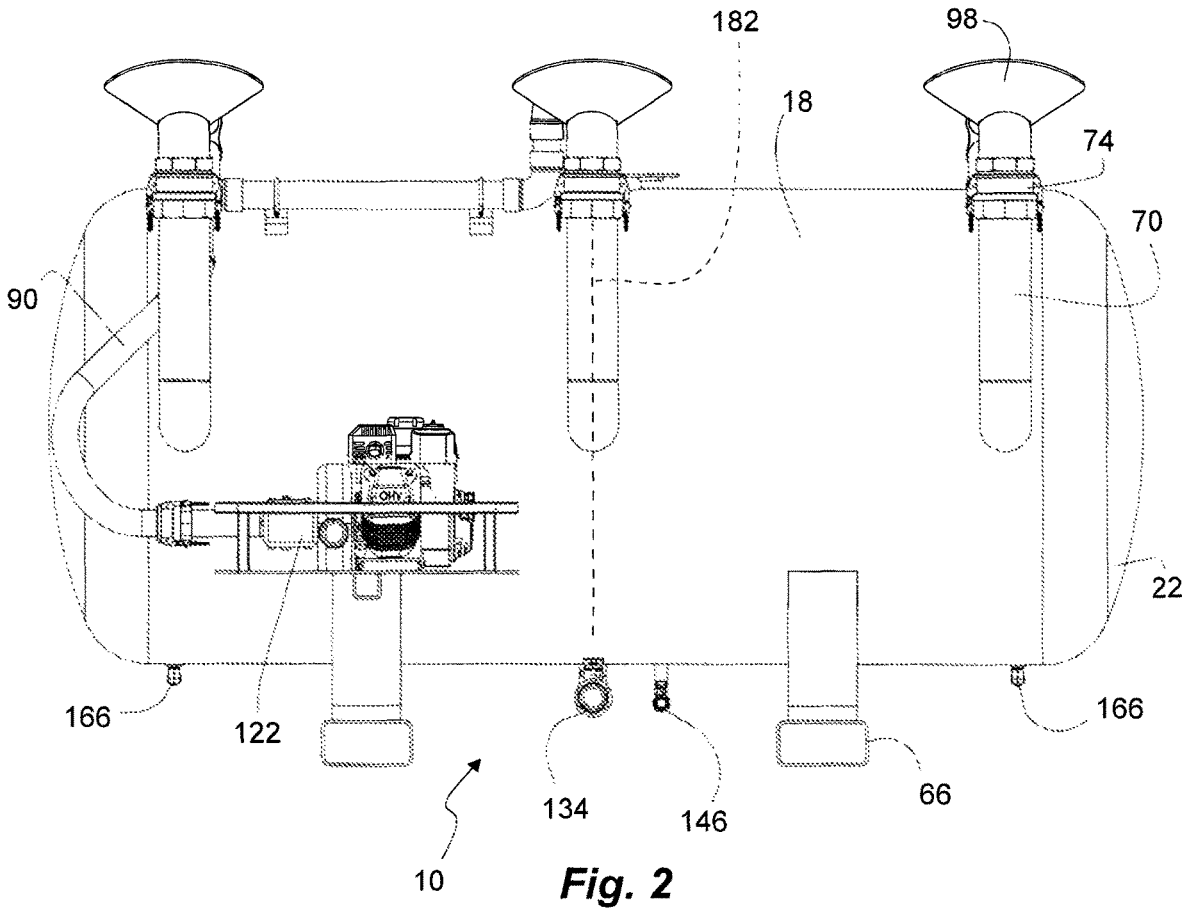
FIG. 2 is a front view of the portable water spreader of FIG. 1, shown in the upright orientation.
Figure 4:
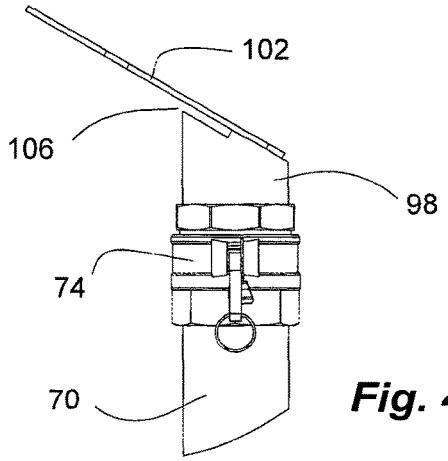
FIG. 4 is a partial detailed side view of the portable water spreader of FIG. 1 showing a spray head in accordance with an embodiment of the invention.
Figure 3:
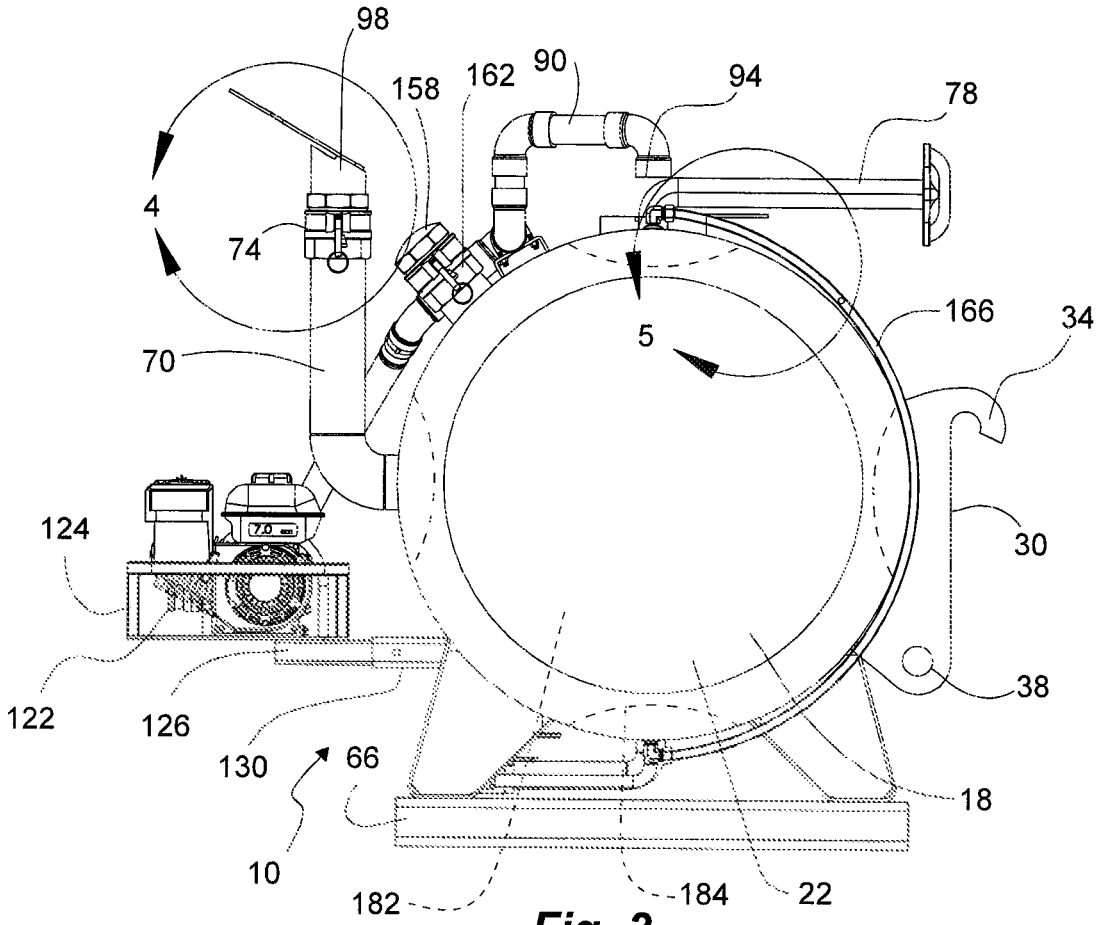
FIG. 3 is a side view of the portable water spreader of FIG. 1, shown in the upright orientation.
Figure 5:
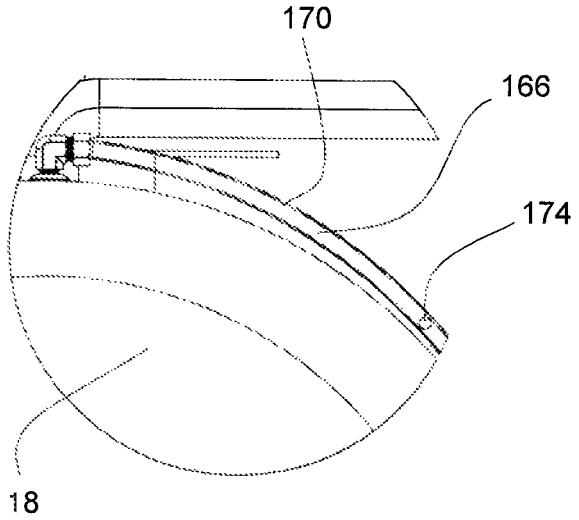
FIG. 5 is a partial detailed side view of the portable water spreader of FIG. 1 showing a level indicator in accordance with an embodiment of the invention.
Figure 6:
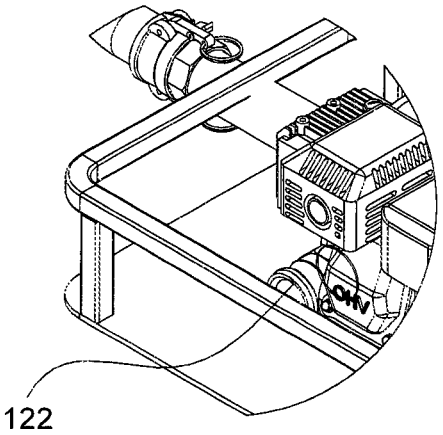
FIG. 6 is a partial detailed side view of the portable water spreader of FIG. 1 showing a pump in accordance with an embodiment of the invention.
Figure 7:
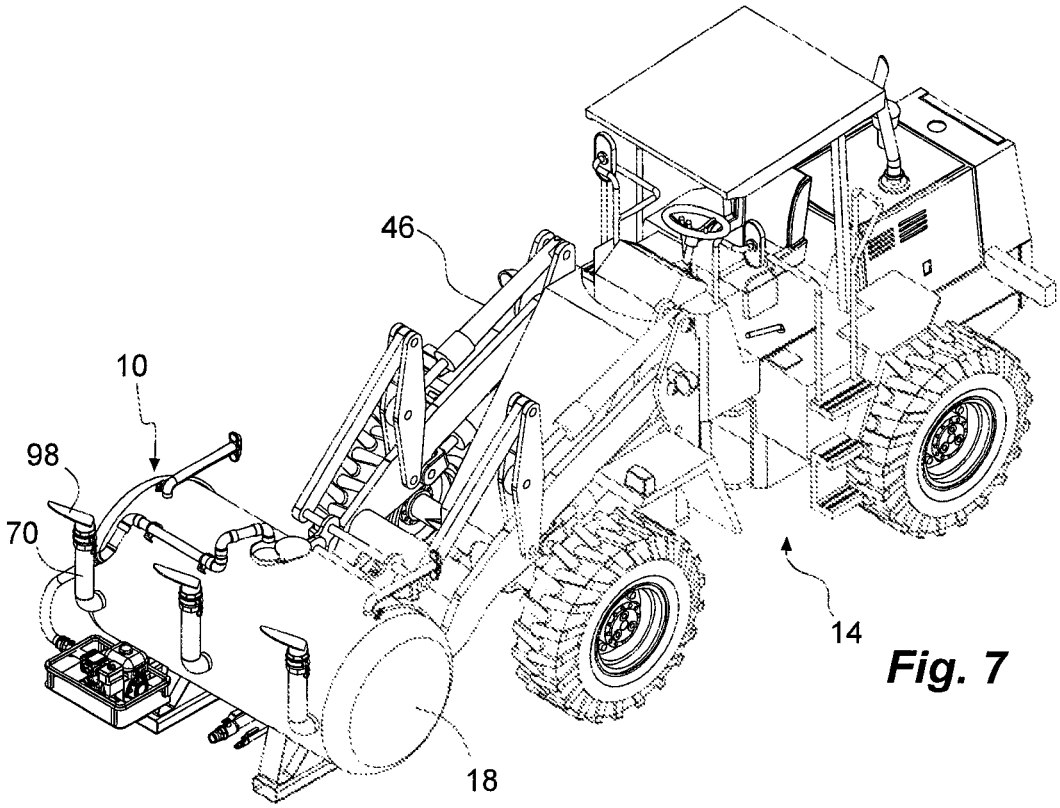
FIG. 7 is a perspective view of the portable water spreader of FIG. 1, shown connected to a front-end loader, and shown in the lowered position and the upright orientation.
Figure 8:
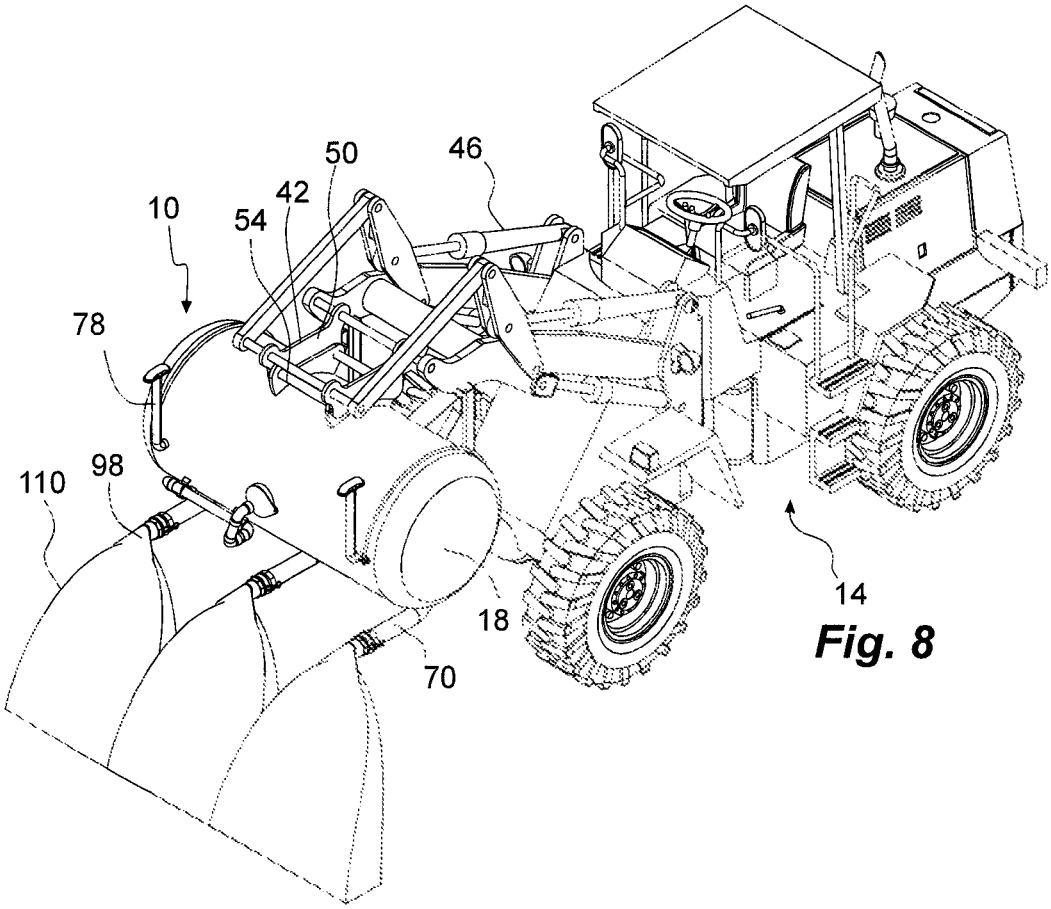
FIG. 8 is a perspective view of the portable water spreader of FIG. 1, shown connected to the front-end loader, and shown in a raised position and a tilted orientation.

The spreader 10, the water tank 18 and the one quick-coupler 26 can have at least two configurations, including: 1) an uncoupled configuration in which the one quick-coupler 26 in uncoupled from the another quick-coupler 42, and the spreader 10 is separated from the front-end loader 14, as shown in FIGS. 1-3; and 2) a coupled configuration in which the one quick-coupler 26 in coupled to the another quick-coupler 42, and the spreader 10 is coupled to and carried by the front-end loader 14 by the quick-couplers 26 and 42, as shown in FIGS. 7-15. In the coupled configuration, the spreader 10 and the water tank 18 are liftable and tiltable by the one portion of the quick-coupler 26 and the tank wall 22 to the raised position and the tilted orientation.

The spreader 10 and the water tank 18 can have a skid 66 coupled to the tank wall 22 and positioned at a bottom of the water tank 18 with the bottom referenced in the upright orientation. The skid 66 can be positioned on the support surface and the ground in the upright orientation and the uncoupled configuration. The skid 66 can maintain the water tank 18 off of the support surface and the ground, and spaced-apart from the support surface and the ground, so that the bottom of the water tank 18 and the bottom of the skid 66 are spaced-apart. The space under the water tank 18 can accommodate drains and fitting as described in greater detail below. In addition, the skid 66 can comprise a pair of rectangular tubes with open ends sized and spaced-apart a distance to receive the forks of a forklift.

Discharge pipe(s) 70 can extend from the water tank 18 and the tank wall 22 to discharge water. The spreader 10 can have at least one discharge pipe 70 in one aspect, at least two discharge pipes 70 in another aspect, three discharge pipes 70 in another aspect, and multiple discharge pipes 70 in another aspect. The discharge pipes 70 can be spaced-apart along a width of the water tank 18 with discharge pipes 70 at the lateral ends of the tank 18 an at least one intermediate discharge pipe 70. Each discharge pipe 70 has a proximal end coupled to the tank wall 22 on a front side of the water tank 18 with the front side referenced in the upright orientation, and opposite the one portion of the quick-coupler 26. In addition, each discharge pipe 70 has a distal end positioned at least at a level of a top of the water tank 18 with the top referenced in the upright orientation. In one aspect, the distal end of the discharge pipes 70 can extend above the top of the water tank 18 to reduce spillage in the upright orientation. In the tilted orientation, the proximal and distal ends of the discharge pipes 70 will be positioned at or lower than the tank 18 to disperse water through the distal ends. In addition, each discharge pipe 70 can have an elbow forming substantially a right angle between the proximal and distal ends. The distal ends of the discharge pipes 70 can have a quick coupling 74. The quick couplings 74 of the discharge pipes 70 can receive spray heads, discharge boom pipe, or caps and discussed in greater detail below.

Vent pipe(s) 78 can extend from the water tank 18 in order to vent the tank 18 to atmosphere and allow smooth flow of fluid out of the discharge pipes 70. The spreader 10 can have one vent pipe 78 in one aspect, two vent pipes 78 in another aspect, and multiple vent pipes 78 in another aspect. The vent pipes 78 have a proximal end coupled to the tank wall 22 on the top of the water tank 18 in the upright orientation and opposite the skid 66. In addition, the vent pipes 78 have a distal end positioned at least at the back side of the water tank 18 in the upright orientation, and positioned at least at a level of the back side of the water tank 18 in the tilted orientation, and positioned above the top of the water tank 18 in the upright orientation. In addition, each vent pipe 78 can have an elbow forming substantially a right angle between the proximal and distal ends. Thus, the proximal and distal ends of the vent pipes 78 are positioned above the water tank 18 in the upright orientation to avoid spillage. The distal ends of the vent pipes 78 allow air into the tank 18 when water is discharged through the discharge pipes 70. The distal ends of the vent pipes 78 can be capped with u-shaped covers to allow air through the distal ends while resisting fouling of the tank 18.

An inlet opening 82 can be formed in the tank wall 22 on the top of the water tank 18 in the upright orientation. A lid 86 can be movably coupled to the water tank 18 and removably coupled over the inlet opening 82. The lid 86 can be a plate sized larger than the inlet opening 82. One end of the lid 86 and the plate can be pivotally coupled to the tank 18 by a hinge, such as a bolt in an oversized hole to allow the plate to pivot and lift. An opposite end of the lid 86 and the plate can have a beveled notch to receive a bolt and a wing nut to hold the lid 86 and the plate in place.

A fill pipe 90 can be coupled to the tank 18 to facilitate filling the tank 18 with water. The fill pipe 90 can have a distal end 94 positioned over the inlet opening 82 and spaced-apart from the inlet opening 82 in the upright orientation to form a gap therebetween to resist siphoning and to resist cross-contamination of liquids. The fill pipe 90 can also have a proximal end below the distal end 94 with a pipe quick-connection. A water source can be coupled to the proximal end of the fill pipe 90. In one aspect, the proximal end can be coupled to a pump as described in greater detail below.

Spray head(s) 98 can be removably coupled to the quick couplings 74 of the distal ends of the discharge pipes 70 to dispense water from the water tank to a location in front of the water tank in the tilted orientation. The number of spray heads 98 can match the number of discharge pipes 70. Thus, the spreader 10 can have at least one spray head 98 in one aspect, at least two spray heads 98 in another aspect, three spray heads 98 in another aspect, and multiple spray heads 98 in another aspect. The spray heads 98 can have quick couplings to connect to the quick couplings 74 of the discharge pipes 70. The spray heads 98 can have an angled plate 102 disposed over an open end thereof to form a semi-circular arcuate opening 106 oriented at an angle with respect to an axis of the discharge pipe 70 to create a fan spray, indicated at 110. The spreader 10 can be configured with the spray heads 98 on the discharge pipes 70 to spray water in front of the spreader 10, as shown by 110 in FIGS. 8 and 12.

Figure 13:
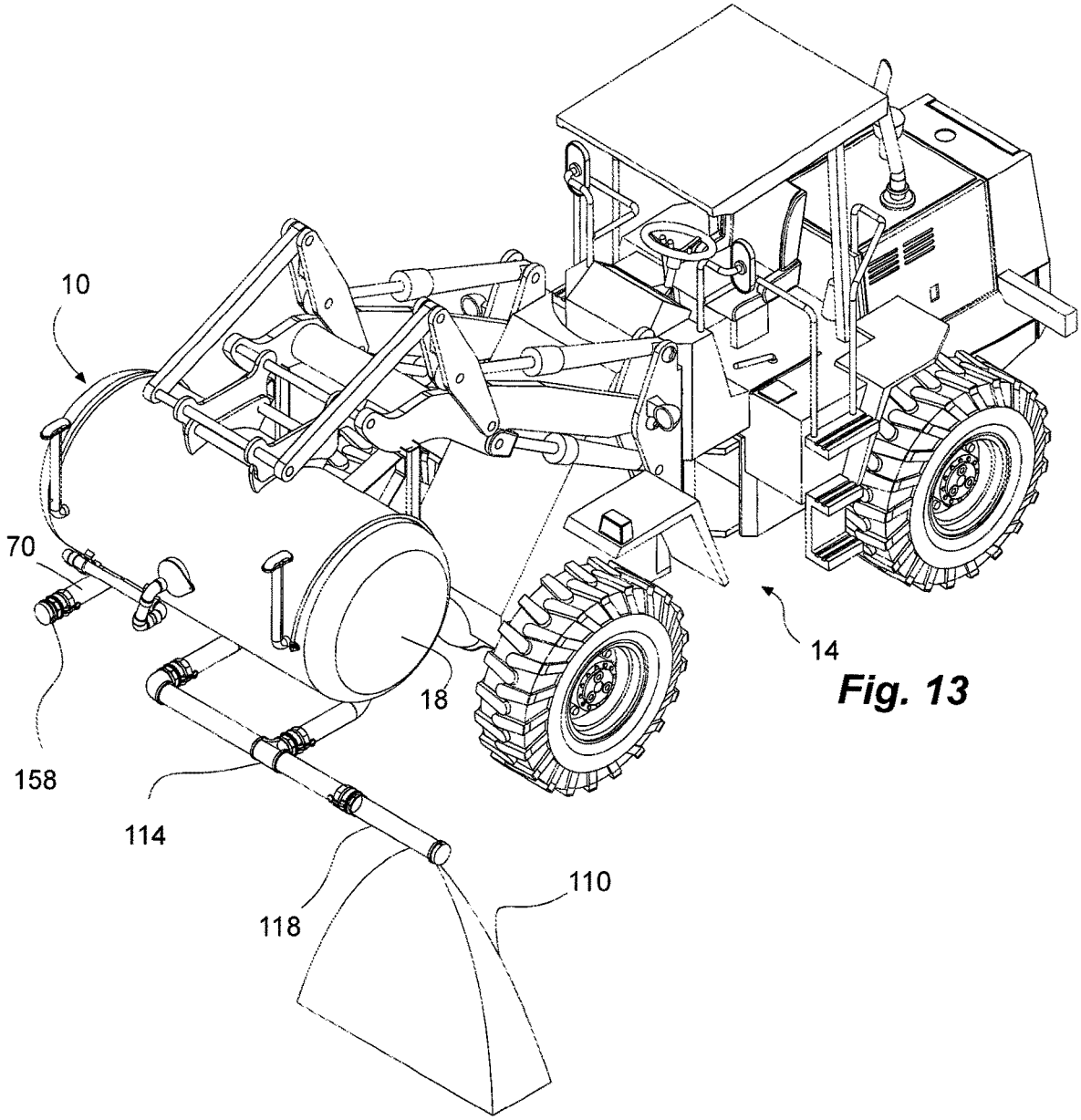
FIG. 13 is a perspective view of the portable water spreader of FIG. 1 with a discharge boom pipe, shown connected to the front-end loader, and shown in the raised position and the tilted orientation.
Figure 14:
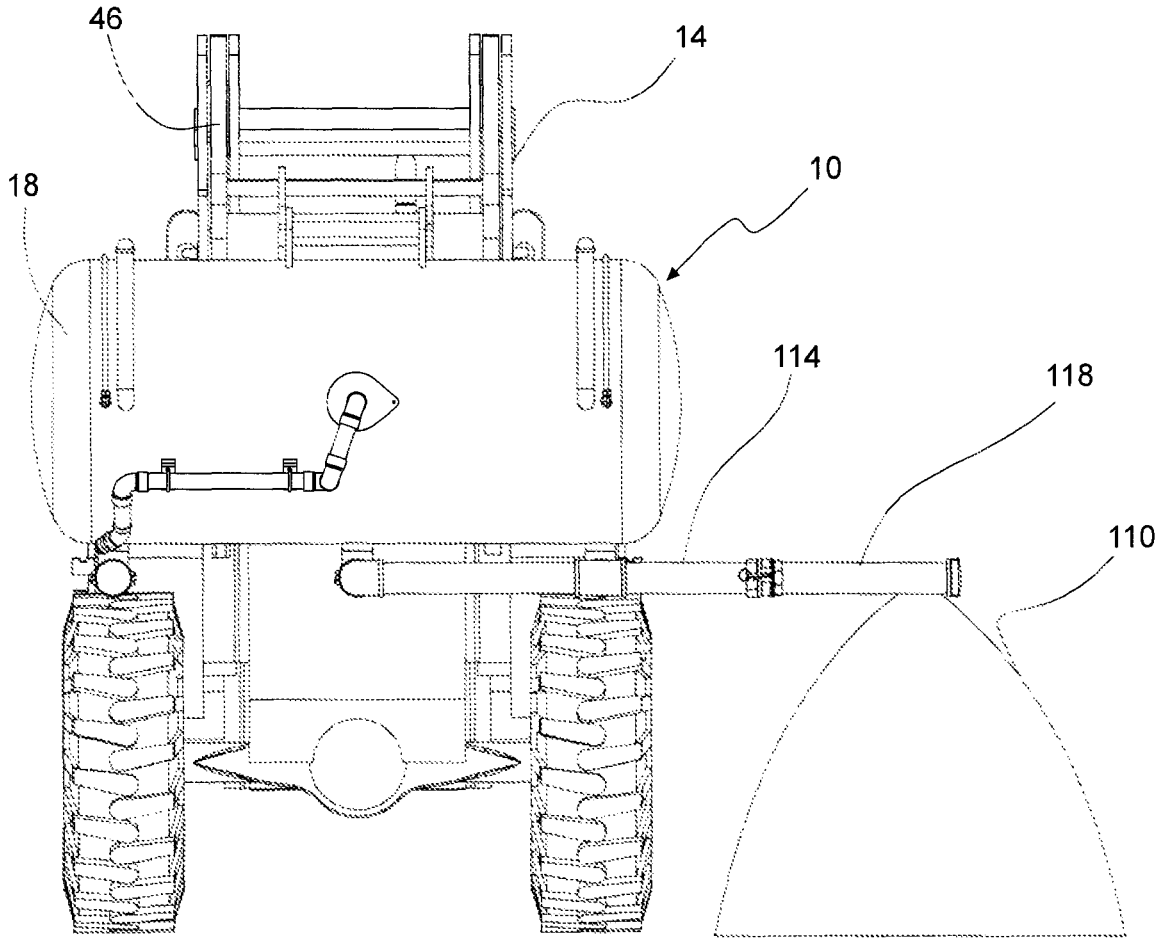
FIG. 14 is a front view of the portable water spreader of FIG. 1, shown connected to the front-end loader, and shown in the raised position and the tilted orientation.
Figure 15:
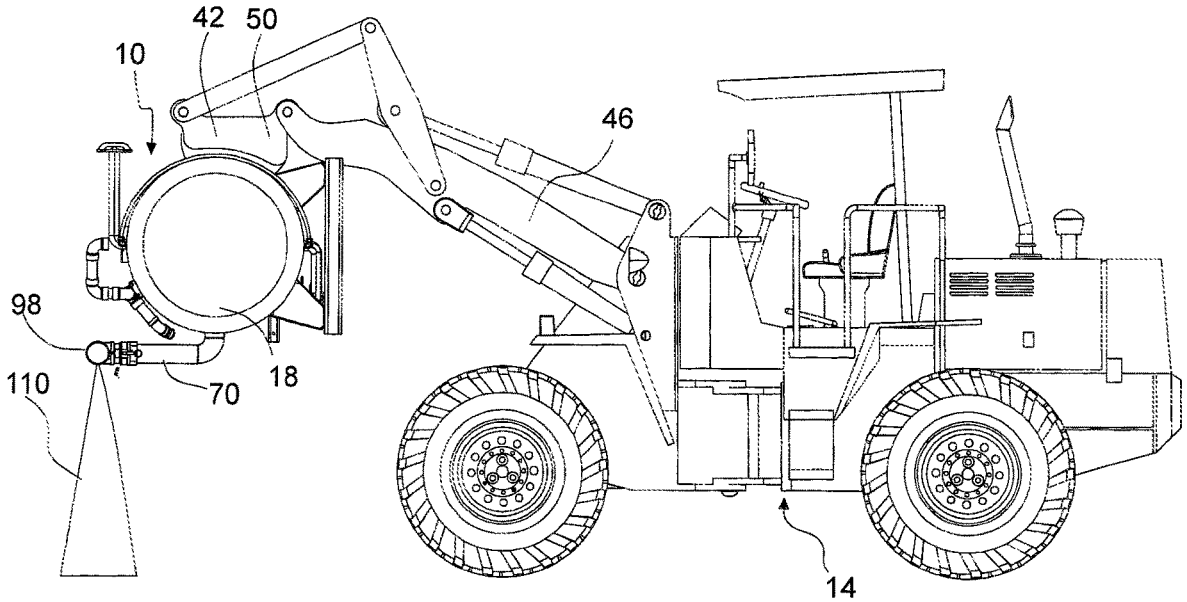
FIG. 15 is a side view of the portable water spreader of FIG. 1, shown connected to the front-end loader, and shown in the raised position and the tilted orientation.

The spreader 10 can be configured to discharge and spray water to a lateral end as well with a discharge boom pipe 114 coupled to the tank 18 and extending laterally beyond the lateral side of the tank 18, as shown in FIGS. 13-15. The discharge boom pipe 114 can be removably coupled to the distal ends, and quick couplers 74, of at least two discharge pipes 70, such as center and side discharge pipes 70. The discharge boom pipe 114 can have quick couplers extending laterally therefrom at a proximal end and an intermediate point for coupling to the quick couplers 74 of the discharge pipes 70. In addition, the discharge boom pipe 114 can have a distal outlet to discharge water therefrom. The pipes described therein, including the discharge boom pipe, can be formed of metal. In one aspect, a distal portion 118 of the discharge boom pipe 114, intercoupled by a connection such as a quick coupler, can be formed of plastic to form a sacrificial tip that can break if inadvertently struck. Thus, the remaining spreader 10 can remain undamaged.

In one aspect, a pump 122 can be removably carried by the skid 66. The pump 122 can be carried in a pump basked 124 coupled to the spreader by a shaft 126 removably received in a receiver 130, as shown in FIG. 3. The pump 122 can be gas powered and can have an inlet and an outlet. The outlet of the pump 122 can be coupled to the proximal end of the fill pipe 90 and the inlet can be coupled to a water source, such as through a hose. Thus, the pump 122 can fill the tank 18 from a standing, unpressurised water source, such as a stream or pond. In another aspect, the proximal end of the fill pipe 90 can be coupled to a pressurized water source, such as a fire hydrant.

In another aspect, the tank 18 can have a bottom port 134 at the bottom of the tank 18 in the upright orientation. The bottom port 134 can have a valve and a quick coupler. In one aspect, the tank 18 can be drained through the bottom port 134. In another aspect, the inlet of the pump 122 can be coupled to the bottom port 134 and a hose can be coupled to the outlet of the pump 122 to discharge the water from the tank 18. In another aspect, a hose bib 146 can be coupled to the water tank 18 at the bottom of thereof to receive a garden hose to discharge water from the tank 18.

In another aspect, at least one cap 158 can be removably coupled to the distal end, and the quick coupler 74, of the discharge pipe 70 to close a respective discharge pipe 70. Thus, a select number of the discharge pipes 70 can be selectively closed to use a select number of spray head 98, and/or during use of the discharge boom pipe 114. At least one dummy fitting 162, with a quick coupler, can be located on the tank wall 22 to removably receive a spray head 98 or a cap 158 when not coupled to the discharge pipe 70. Thus, the dummy fitting 162 can keep the spray head 98 or the cap 158 handy and resist loss.

In another aspect, a level indicator 166 can be coupled to the tank 18 to indicate a volume, amount and level of water in the tank 18. The level indicator 166 can include a clear tube 170 coupled to the tank 18 and extending upwards near a top of the tank in the upright orientation. In one aspect, the clear tube 170 can be fluidly coupled to the bottom and top of the tank 18 in the upright orientation. A float 174 can be contained in the clear tube 170 to indicate the level of water.

As described above, the tank 18 can have a volume between 150 to 1500 gallons. The tank 18 can be elongated to accommodate greater volume. The tank 18 can have at least one baffle 182 in one aspect, and multiple baffles 182 in another aspect. The baffle(s) 182 can be located in the tank 18 and can bifurcate the volume length-wise. For example, a center baffle 182 can be disposed in the center of the tank, and can extend fore and aft, to divide the tank 18 into at least left and right sides. The baffle 182 can have openings 184, such as top and bottom openings, and front and back openings, in the upright orientation. Thus, the left and right sides of the tank 18 are open to one another at the top and bottom while the tank 18 is oriented upright or tilted. The openings allow water pass through both the left and right sides, while the baffle 182 resists large shifts of the water, and sloshing.

A method for spreading water and for using the spreader 10 can comprise:

- coupling another portion of the quick-coupler 42 of the front-end loader 14 to the one portion of the quick-coupler 26 of the water tank 18;
- opening the lid 86;
- connecting a water source to the fill pipe 90;
- filling the water tank 18 with water through the fill pipe 90 and inlet opening 82 of the water tank 18;
- closing the lid 86;
- raising the water tank 18 to the raised position with a boom 46 of the front-end loader 14;
- positioning the water tank 18 with the front-end loader 14;
- tilting the water tank 18 to the tilted orientation with the boom 46 of the front-end loader 14 and dispersing water through the discharge pipes 70;
- moving the front-end loader 14 while dispersing the water;
- tilting the water tank 18 to the upright orientation with the boom 46 of the front-end loader 14; and
- lowering the water tank 18 to the lowered position on a support surface with the boom 46 of the front-end loader 14.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A portable water spreader system configured for constructing road base, the system comprising:

a) a structural water tank having a tank wall and a volume of at least 150 gallons, the water tank being vertically displaceable between:
i) a lowered position, and
ii) a raised position elevated above the ground, and the water tank being tiltable between:
i) an upright orientation, and
ii) a tilted orientation substantially 90 degrees from the upright orientation;

b) one portion of a quick-coupler of a front-end loader carried by the tank wall and positioned on a back side of the water tank in the upright orientation, the water tank being liftable by the one portion of the quick-coupler to the raised position;

c) a skid coupled to the tank wall and positioned at a bottom of the water tank in the upright orientation;

d) at least two discharge pipes each having a proximal end coupled to the tank wall on a front side of the water tank in the upright orientation and opposite the one portion of the quick-coupler, and each having a distal end positioned at least at a level of a top of the water tank in the upright orientation;

e) a vent pipe having a proximal end coupled to the tank wall on the top of the water tank in the upright orientation and opposite the skid, and having a distal end positioned at least at a level of the back side of the water tank in the tilted orientation, and the distal end positioned above the top of the water tank in the upright orientation;

f) an inlet opening in the tank wall on the top of the water tank in the upright orientation;

g) a lid movably coupled to the water tank and removably coupled over the inlet opening;

h) a fill pipe having a distal end positioned over the inlet opening and spaced-apart from the inlet opening in the upright orientation, and having a proximal end below the distal end with a pipe quick-connection;

i) at least two spray heads removably coupled to the distal ends of the at least two discharge pipes and configured to dispense water from the water tank to a location in front of the water tank in the tilted orientation; and j) a discharge boom pipe removably coupled to the distal ends of the at least two discharge pipes and extending laterally beyond a lateral end of the water tank to an outlet configured to dispense water from the water tank to a location to a lateral end of the water tank in the tilted orientation.

2. The system in accordance with claim 1, further comprising:

a pump carried by the skid and couplable to the proximal end of the fill pipe.

3. The system in accordance with claim 1, further comprising:

a) at least two caps removably coupled to the distal ends of the at least two discharge pipes and configured to close a respective discharge pipe; and b) at least two dummy fittings on the tank wall each removably receiving a spray head or a cap when not coupled to the discharge pipe.

4. The system in accordance with claim 1, further comprising a level indicator comprising:

a) a clear tube coupled to the tank and extending upwards near a top of the tank in the upright orientation; and b) a float in the clear tube.

5. The system in accordance with claim 1, wherein the one portion of the quick-coupler of the front-end loader further comprises:

a) a pair of flanges laterally spaced-apart on the back side of the water tank;

b) a hook at a top of each of the pair of flanges; and c) a bore at a bottom of each of the pair of flanges.

6. The system in accordance with claim 5, further comprising:

a) another portion of the quick-coupler of the front-end loader configured to be carried by a boom of the front-end loader, and comprising:

b) a bracket;

c) at least one bar at a top of the bracket and corresponding to the hooks of the pair of flanges;

d) at least one bore at a bottom of the bracket and corresponding to the bore in each of the pair of flanges; and e) at least one pin removably received in the at least one bore of the bracket and the bore in each of the pair of flanges.

7. The system in accordance with claim 1 in combination with a front-end loader, the system further comprising:

a) another portion of the quick-coupler of the front-end loader carried by a boom of the front-end loader; and b) the water tank removably coupled to the boom of the front-end loader by the quick-coupler.

8. A method for spreading water using the system in accordance with claim 1, the method comprising:

a) coupling another portion of the quick-coupler of the front-end loader to the one portion of the quick-coupler of the water tank;

b) opening the lid;

c) connecting a water source to the fill pipe;

d) filling the water tank with water through the fill pipe and inlet opening of the water tank;

e) raising the water tank to the raised position with a boom of the front-end loader;

f) positioning the water tank with the front-end loader;

g) tilting the water tank to the tilted orientation with the boom of the front-end loader and dispersing water through the at least two discharge pipes;

h) moving the front-end loader while dispersing the water;

i) tilting the water tank to the upright orientation with the boom of the front-end loader; and j) lowering the water tank to the lowered position on a support surface with the boom of the front-end loader.

9. A portable water spreader system, comprising:

a) a water tank having a tank wall, the water tank being vertically displaceable between:
i) a lowered position, and
ii) a raised position elevated above the ground, and the water tank being tiltable between:
i) an upright orientation, and
ii) a tilted orientation substantially 90 degrees from the upright orientation;

b) one portion of a quick-coupler of a front-end loader carried by the tank wall and positioned on a back side of the water tank in the upright orientation, the water tank being liftable by the one portion of the quick-coupler to the raised position;

c) a skid coupled to the tank wall and positioned at a bottom of the water tank in the upright orientation;

d) at least two discharge pipes each having a proximal end coupled to the tank wall on a front side of the water tank in the upright orientation and opposite the one portion of the quick-coupler, and each having a distal end positioned at least at a level of a top of the water tank in the upright orientation;

e) a vent pipe having a proximal end coupled to the tank wall on the top of the water tank in the upright orientation and opposite the skid, and having a distal end positioned at least at a level of the back side of the water tank in the tilted orientation, and the distal end positioned above the top of the water tank in the upright orientation;

f) an inlet opening in the tank wall on the top of the water tank in the upright orientation;

g) a lid movably coupled to the water tank and removably coupled over the inlet opening;

h) a fill pipe having a distal end positioned over the inlet opening and spaced-apart from the inlet opening in the upright orientation, and having a proximal end below the distal end with a pipe quick-connection;

i) at least two spray heads removably coupled to the distal ends of the at least two discharge pipes and configured to dispense water from the water tank to a location in front of the water tank in the tilted orientation; and j) a discharge boom pipe removably coupled to the distal ends of the at least two discharge pipes and extending laterally beyond a lateral end of the water tank to an outlet configured to dispense water from the water tank to a location to a lateral end of the water tank in the tilted orientation.

10. The system in accordance with claim 9, wherein the water tank is a structural water tank with the tank wall being capable of carrying weight of at last 150 gallons of water when the tank is filled and suspended by the one portion of the quick-coupler of the front-end loader.

11. The system in accordance with claim 9, further comprising:

a pump carried by the skid and couplable to the proximal end of the fill pipe.

12. The system in accordance with claim 9, further comprising:

a) at least two caps removably coupled to the distal ends of the at least two discharge pipes and configured to close a respective discharge pipe; and b) at least two dummy fittings on the tank wall each removably receiving a spray head or a cap when not coupled to the discharge pipe.

13. The system in accordance with claim 9, further comprising a level indicator comprising:

a) a clear tube coupled to the tank and extending upwards near a top of the tank in the upright orientation; and b) a float in the clear tube.

14. The system in accordance with claim 9, wherein the one portion of the quick-coupler of the front-end loader further comprises:

a) a pair of flanges laterally spaced-apart on the back side of the water tank;

b) a hook at a top of each of the pair of flanges; and c) a bore at a bottom of each of the pair of flanges.

15. The system in accordance with claim 14, further comprising:

a) another portion of the quick-coupler of the front-end loader configured to be carried by a boom of the front-end loader, and comprising:

b) a bracket;

c) at least one bar at a top of the bracket and corresponding to the hooks of the pair of flanges;

d) at least one bore at a bottom of the bracket and corresponding to the bore in each of the pair of flanges; and e) at least one pin removably received in the at least one bore of the bracket and the bore in each of the pair of flanges.

16. The system in accordance with claim 9 in combination with a front-end loader, the system further comprising:

a) another portion of the quick-coupler of the front-end loader carried by a boom of the front-end loader; and b) the water tank removably coupled to the boom of the front-end loader by the quick-coupler.

17. A method for spreading water using the system in accordance with claim 9, the method comprising:

a) coupling another portion of the quick-coupler of the front-end loader to the one portion of the quick-coupler of the water tank;

b) opening the lid;

c) connecting a water source to the fill pipe;

d) filling the water tank with water through the fill pipe and inlet opening of the water tank;

e) raising the water tank to the raised position with a boom of the front-end loader;

f) positioning the water tank with the front-end loader;

g) tilting the water tank to the tilted orientation with the boom of the front-end loader and dispersing water through the at least two discharge pipes;

h) moving the front-end loader while dispersing the water;

i) tilting the water tank to the upright orientation with the boom of the front-end loader; and j) lowering the water tank to the lowered position on a support surface with the boom of the front-end loader.

* * * * *